US010805734B2

(12) United States Patent
Bian

(10) Patent No.: US 10,805,734 B2
(45) Date of Patent: Oct. 13, 2020

(54) INTERFERENCE-FREE MAGNETIC STRUCTURE AND ISOMAGNETIC SPEAKER

(71) Applicant: Fang Bian, Tianjin (CN)

(72) Inventor: Fang Bian, Tianjin (CN)

( * ) Notice: Subject to any disclaimer, the term of this patent is extended or adjusted under 35 U.S.C. 154(b) by 0 days.

(21) Appl. No.: 16/529,695

(22) Filed: Aug. 1, 2019

(65) Prior Publication Data

US 2020/0196061 A1 Jun. 18, 2020

(30) Foreign Application Priority Data

Dec. 17, 2018 (CN) ..... 2018 1 1541934

(51) Int. Cl.
*H04R 9/02* (2006.01)
*H01F 7/02* (2006.01)
*H04R 9/06* (2006.01)

(52) U.S. Cl.
CPC ..... *H04R 9/025* (2013.01); *H01F 7/02* (2013.01); *H04R 9/06* (2013.01)

(58) Field of Classification Search
CPC . H04R 9/02; H04R 9/025; H04R 9/06; H04R 9/047; H04R 9/048
USPC ..... 381/386, 412, 414, 421, 422, 408, 431
See application file for complete search history.

(56) References Cited

U.S. PATENT DOCUMENTS

2004/0047488 A1* 3/2004 Levitsky ..... H04R 9/048 381/399
2015/0110339 A1* 4/2015 Colich ..... H04R 7/20 381/424
2016/0142824 A1* 5/2016 Clark ..... H04R 7/04 381/423

FOREIGN PATENT DOCUMENTS

CN 2506046 Y 8/2002
CN 1512818 A 7/2004
CN 204442661 U 7/2015
EP 1434463 A2 6/2004

* cited by examiner

*Primary Examiner* — Melur Ramakrishnaiah
(74) *Attorney, Agent, or Firm* — BakerHostetler

(57) ABSTRACT

An isomagnetic speaker comprising a diaphragm and an interference-free magnet structure is described herein. The interference-free magnet structure comprises a magnet array disposed to correspond with a predetermined region of the diaphragm and comprising a plurality of permanent magnets disposed at equal intervals along at least one direction. A plurality of bottoms of the plurality of permanent magnets are arranged on a same plane and oriented toward the diaphragm. A magnetic field direction of each permanent magnet is perpendicular to a corresponding bottom. A maximum size of a length of each permanent magnet along a direction parallel to the diaphragm is smaller than or equal to $c/2\pi f_{min}$, wherein c is a sound wave speed, and $f_{min}$ is a minimum output audio frequency of the isomagnetic speaker.

20 Claims, 8 Drawing Sheets

INTERFERENCE-FREE MAGNETIC STRUCTURE AND ISOMAGNETIC SPEAKER

CROSS-REFERENCE TO RELATED APPLICATION

The present disclosure claims priority of Chinese Patent Application No. 201811541934.0, filed on Dec. 17, 2018. The entire disclosure of the above-identified application is hereby incorporated by reference herein and made a part of this specification.

Some references, if any, which may include patents, patent applications and various publications, may be cited and discussed in the description of this application. The citation and/or discussion of such references, if any, is provided merely to clarify the description of the present disclosure and is not an admission that any such reference is "prior art" to the application described herein. All references listed, cited and/or discussed in this specification are incorporated herein by reference in their entireties and to the same extent as if each reference was individually incorporated by reference.

BACKGROUND

Currently, electroacoustic speakers may be roughly categorized into isomagnetic speakers, moving-coil speakers, piezoelectric speakers and electrostatic speakers based on driving manners.

The isomagnetic speaker can be divided into a push-pull type and a single-end type from magnet division structure. The isomagnetic speaker integrates advantages of the moving-coil speaker and the electrostatic speaker, and it has better performance in low frequency than the electrostatic speaker, and it is also better in high frequency than the moving-coil speaker. The structure of core transducer is often to fix a flexible vibrating diaphragm onto a hollow framework, the vibrating diaphragm is provided with a (single-end) magnet yoke on one side or (push-pull type) magnet yokes respectively on both sides, where a plurality of bar-shaped or circular permanent magnets (which often use NdFeB magnets with brand Nos. N50 and more) are fixed, and coils are provided on a location of the vibrating diaphragm opposite to a magnetic pole face of the permanent magnet. A current flowing inside the coils is orthogonal to a magnetic field generated by the permanent magnet, so that the coils produce a force following Faraday's law by inputting an alternating current (AC) into the coils, the vibrating diaphragm vibrates along the direction perpendicular to its surface under the action of this force, and the AC signal is converted into a sound signal.

Permanent magnets of the single-end type isomagnetic speaker are provided on one side of the vibrating diaphragm, and regardless of intensity or uniformity of the magnetic field, both are affected. In particular, in the aspect of uniformity of the magnetic field, the intensity of the magnetic field produced by the permanent magnets attenuates rapidly (which is inversely proportional to the third power of distance) as the distance increases, so that the force suffered when the vibrating diaphragm vibrates away from the permanent magnets in the vertical direction attenuates rapidly, and a response speed becomes worse.

Permanent magnets of the push-pull type isomagnetic speaker are provided on a path communicating a sound wave from the vibrating diaphragm to listeners, resulting in a certain degree of attenuation of the sound wave. In particular, blocking of the low frequency sound wave is even obvious, which affects recovery of the sound wave. Moreover, no matter whether the available permanent magnets are ring-shaped or bar-shaped, sectional shapes are both rectangular, so that the sound wave produces multiple reflections among the permanent magnets to cause energy loss, and is even coherent to form standing wave. The user feels disorder of the sound field, and space levels and resolution of sound become worse.

SUMMARY OF THE APPLICATION

An objective of the present disclosure is to provide an interference-free magnetic structure for an isomagnetic speaker with respect to deficiencies of the structure in the prior art, so as to solve the problem of poor low frequency sound effect and disorder of the sound field in the isomagnetic speaker.

The example of the present disclosure provides an interference-free magnetic structure for an isomagnetic speaker, comprising a magnet array consisting of a plurality of permanent magnets in an arrangement of equal intervals along any direction and disposed corresponding to a region of coils of a vibrating diaphragm of the isomagnetic speaker; the permanent magnet including a bottom, a top and a waist connecting the top and the bottom, wherein the bottom is a plane, a magnetic field direction of the permanent magnet is perpendicular to the bottom, and bottoms of the plurality of permanent magnets share the same plane and are oriented to the coils of the vibrating diaphragm; and the maximum size of the permanent magnet along a plane direction parallel to the coils of the vibrating diaphragm being smaller than or equal to $c/2\pi f_{min}$, wherein c is a sound wave speed, $f_{min}$, is the minimum output audio of the isomagnetic speaker.

In one preferable example, L is the maximum size of the permanent magnet along the plane direction parallel to the coils of the vibrating diaphragm, 2.4 mm≤L≤10 m.

In one preferable example, H is the maximum size of the permanent magnet along a direction perpendicular to the coils of the vibrating diaphragm, 5 mm≤H≤20 m.

In one preferable example, a sum of areas of the bottoms of the plurality of permanent magnets is larger than or equal to one third of an area of the region of the coils of the vibrating diaphragm, and is smaller than or equal to two thirds of the area of the region of the coils of the vibrating diaphragm.

In one preferable example, an area of the top of the permanent magnet is smaller than an area of the bottom.

In one preferable example, the waist includes a contraction part that gradually contracts from at least ⅕H from the top to the top.

In one preferable example, a unilateral outer contour line of the contraction part along a direction perpendicular to the coils of the vibrating diaphragm is an arcuate curve. The arcuate curve is a hyperbolic curve, an arc, an elliptic arc, a parabola, an involute, an asteroid, an epicycloid, a hypocycloid, a catenary, a Cayley's Sextic, a cochleoid, a tractrix, a conchoids, a double folium, a spiral line, or a combination thereof.

In one preferable example, the unilateral outer contour line of the contraction part along the direction perpendicular to the coils of the vibrating diaphragm is a straight line, or a broken line consisting of a plurality of line segments.

In one preferable example, a sectional shape of the permanent magnet along the direction perpendicular to the coils of the vibrating diaphragm is an isosceles triangle, an isosceles trapezoid, a semicircle or a semi-ellipse.

In one preferable example, the permanent magnet has rotational symmetry along the direction perpendicular to the coils of the vibrating diaphragm.

In one preferable example, the bottom is a regular polygon, a circle, an ellipse, or a rectangle.

In one preferable example, the bottom is an annulus, and the plurality of permanent magnets are sheathed at an equal interval along a radial direction.

In one preferable example, radial sizes of bottoms of the plurality of permanent magnets are the same, or are decreased inwardly along the radial direction.

In one preferable example, an arcuate chamfering is provided between the waist and the bottom.

As compared to the prior art, advantageous effects of the examples of the present disclosure are to enhance recovery of the low frequency sound wave by adjusting a spatial size of the permanent magnets, reduce interference of the permanent magnets to the sound in the available isomagnetic speaker, efficiently improve sound field of the speaker, and raise space levels and resolution of the speaker by optimizing sectional shapes of the permanent magnets on the premise of ensuring intensity of the magnetic field.

BRIEF DESCRIPTION OF THE DRAWINGS

The following detailed description may be better understood when read in conjunction with the appended drawings. For the purposes of illustration, there are shown in the drawings example embodiments of various aspects of the disclosure; however, the invention is not limited to the specific methods and instrumentalities disclosed.

DESCRIPTION OF THE ILLUSTRATIVE EMBODIMENTS

Hereinafter a further detailed explanation of the present disclosure is provided in connect with the appended drawings, so as to facilitate understanding of those skilled in the art.

Example 1

Figure 1:
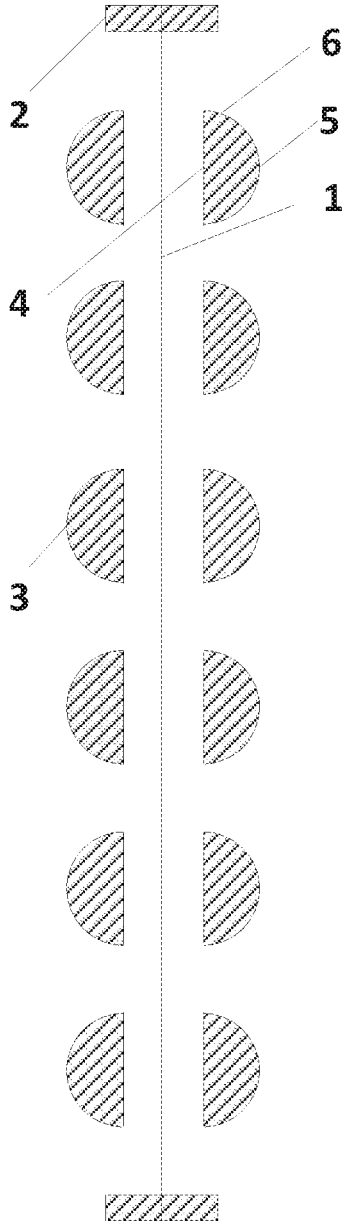
FIG. 1 is a schematic diagram illustrating example isomagnetic speaker in accordance with the present disclosure.
Figure 2:
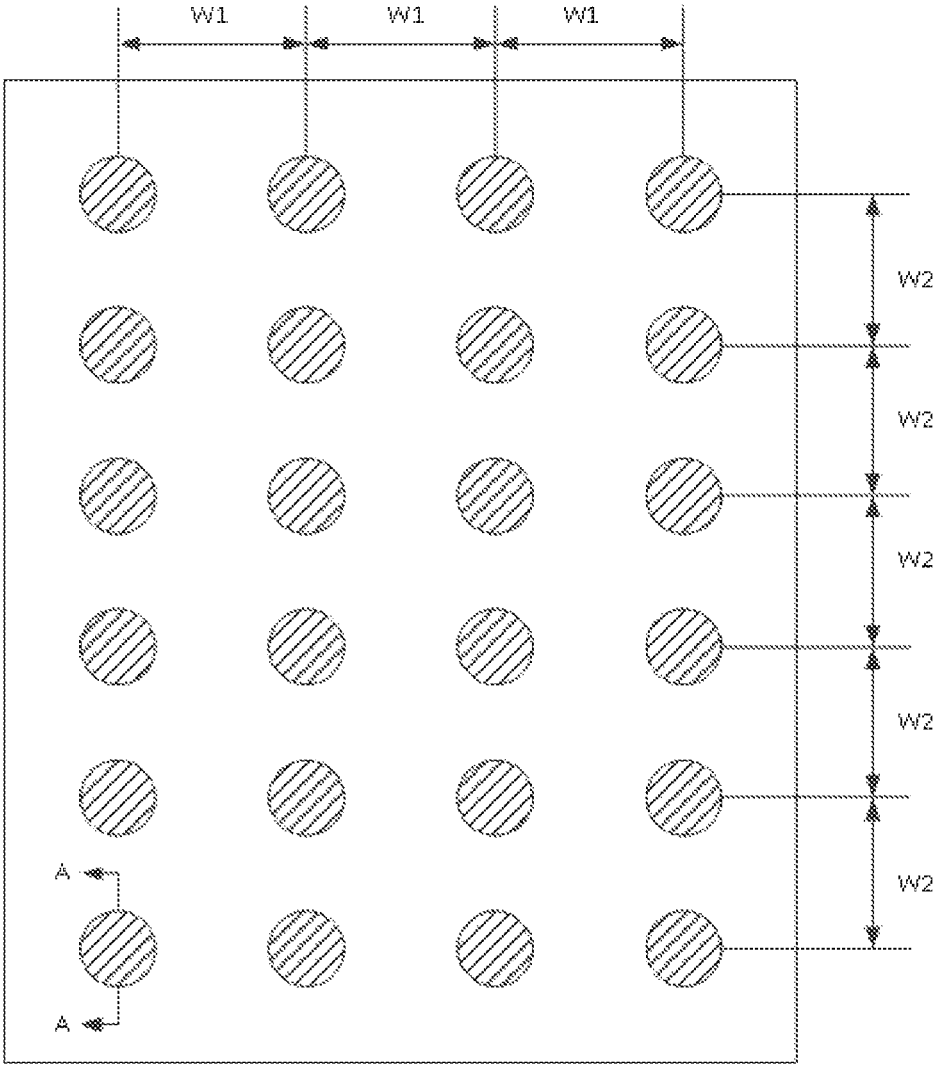
FIG. 2 is a schematic diagram illustrating example magnet array of an interference-free magnetic structure for an isomagnetic speaker in accordance with the present disclosure.

Referring to FIG. 1, FIG. 1 illustrates an isomagnetic speaker. The isomagnetic speaker comprises a vibrating diaphragm 1 with a periphery fixed by a framework 2, and coils on the vibrating diaphragm 1 are electrically connected to a signal line. Magnet yokes are respectively configured on both sides of the vibrating diaphragm 1, and comprise an array consisting of a plurality of permanent magnets 3 parallel to the vibrating diaphragm 1. The permanent magnet array is disposed corresponding to a region of the coils on the vibrating diaphragm 1, so as to ensure intensity of the magnetic field on the vibrating diaphragm 1, and enhance energy conversion efficiency. Referring to FIG. 2, FIG. 2 illustrates an example permanent magnet array of an interference-free magnetic structure for an isomagnetic speaker. It should be appreciated that the permanent magnets may have any other different shapes. As shown in FIG. 2 the permanent magnets 3 are arranged at an equal interval along any direction. The permanent magnets 3 in magnet yokes on both sides of the vibrating diaphragm 1 have the same size, and interval of the permanent magnets 3 can be the same, i.e., using a symmetrical structure. The interval in different directions may be equal, and also may be unequal. For example, the interval W1 in the first direction is different from the interval W2 in the second direction. Magnet yokes and coils on the vibrating diaphragm are omitted in the figures.

Figure 3:
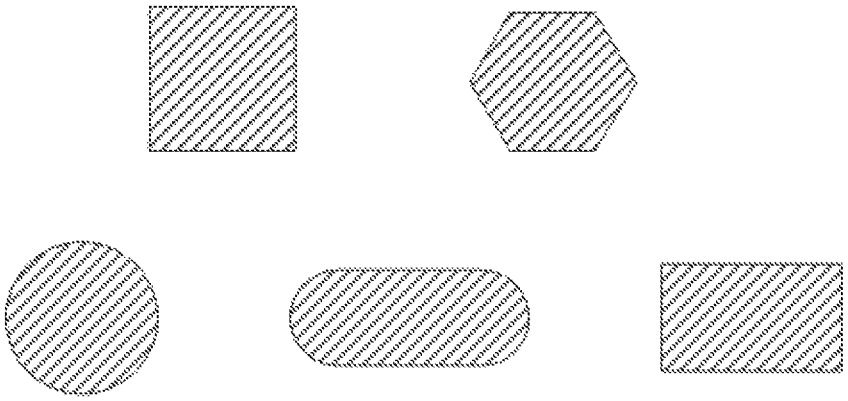
FIG. 3 is a schematic diagram illustrating example bottom of a permanent magnet in accordance with the present disclosure.

The permanent magnet 3 has rotational symmetry along the direction perpendicular to the coils of the vibrating diaphragm, and comprises a bottom 4, a top 5, and a waist 6 connecting the top 5 and the bottom 4. The bottom 4 is a plane, and the bottoms 4 of the plurality of permanent magnets 3 in the array share the same plane and are oriented to the coils of the vibrating diaphragm 1. Referring to FIG. 3, FIG. 3 illustrates a permanent magnet structure of the interference-free magnetic structure for an isomagnetic speaker in this example, and the bottom 4 of the permanent magnet 3 is a regular polygon, a circle, an ellipse, or a rectangle. In addition, the bottom 4 is also used as a magnetic pole of the permanent magnet 3, so that the magnetic field direction of the permanent magnet 3 is perpendicular to the bottom 4, and then perpendicular to the coils on the vibrating diaphragm 1. An arcuate chamfering is provided between the waist 6 and the bottom 4. The permanent magnet 3 uses a NdFeB magnet, and the higher the intensity of the magnetic field provided by the permanent magnet 3 is, the higher the ring energy efficiency of the speaker will be. Physical characteristics of the NdFeB magnet adapted to the speaker are shown in blow chart:

| Brand No. | Remanent Magnetization Br | | Coercive Force Hcb | | Intrinsic Coercive Force Hcj | | Maximum Magnetic Energy $(Bh)_{max}$ | | Working Temperature Tw |
|---|---|---|---|---|---|---|---|---|---|
| Grade | mT | kGs | kA/m | k0e | kA/m | k0e | kJ/m³ | MG0e | ° C. |
| N35 | 1170-1220 | 11.7-12.2 | >868 | >10.9 | >955 | >12 | 263-287 | 33-36 | <80 |
| N38 | 1220-1250 | 12.2-12.5 | >899 | >11.3 | >955 | >12 | 287-310 | 38-39 | <80 |
| N40 | 1250-1260 | 12.5-12.8 | >907 | >11.4 | >955 | >12 | 302-326 | 38-41 | <80 |
| N42 | 1280-1320 | 12.8-13.2 | >915 | >11.5 | >955 | >12 | 318-342 | 40-43 | <80 |
| N48 | 1380-1420 | 13.8-14.2 | >923 | >11.6 | >955 | >12 | 366-390 | 46-49 | <80 |
| N50 | 1400-1450 | 14.0-14.5 | >796 | >10 | >876 | >11 | 382-406 | 48-49 | <80 |
| N52 | 1430-1480 | 14.3-14.8 | >796 | >10 | >876 | >11 | 398-422 | 50-53 | <80 |

As can be known from the above chart, the maximum brand No. of the NdFeB magnet used by the speaker is often N52 according to the performance parameters of the NdFeB magnet.

The maximum size of the permanent magnet 3 along a plane direction parallel to the coils of the vibrating diaphragm is smaller than or equal to $c/2\pi f_{min}$, wherein c is a sound wave speed (generally, 340 m/s), $f_{min}$, is the minimum output audio of the isomagnetic speaker. When the size of the permanent magnet 3 satisfies the above condition, the low frequency sound wave produced by the vibrating diaphragm 1 produces diffraction of sound wave at the permanent magnet array, and then forms a complete sound field bypassing the permanent magnets 3 in the array, thereby enhancing sound effect of the low frequency sound wave of the isomagnetic speaker. An audio range outputted by the speaker is often 20 Hz to 20 KHz, and the maximum size of the permanent magnet 3 perpendicular to a sound propagation direction (parallel to a plane direction of the vibrating diaphragm 1) is selected to be in a range of 2.7 mm to 2.7 m. In order to be suitable for a wider usage, the size of the permanent magnet 3 is selected to be in a range of 2.4 mm to 10 m, so as to be adapted to outputting the sound wave in ranges of infrasonic wave and ultrasonic wave.

As to the speaker with use of outputting audible audio, in order to improve comfortability of the user, a weight of the speaker has to be controlled, so a volume of the permanent magnet 3 shall be adapted to use requirements of portability of the speaker. Meanwhile, in order to enhance electroacoustic energy conversion efficiency, ensure the intensity of the magnetic field, and ensure integrity and good yield of the permanent magnet during production, a thickness of the permanent magnet 3 shall not be less than 0.5 cm. When selecting the NdFeB material, a size of the permanent magnet 3 is further affected by magnetism of the material. The NdFeB magnet has a poor magnetic permeability, and the intensity of the magnetic field attenuates rapidly as the distance increases, so effect of improving the intensity of the magnetic field is limited when the thickness of the permanent magnet 3 is greater than 7 cm. Further preferably, on the premise of controlling quality of the speaker, the thickness of the permanent magnet 3 is preferably 1 cm to 5 m.

In addition to the size of the permanent magnet 3 perpendicular to the sound propagation direction, an interval between the permanent magnets 3 in the permanent magnet array also has an influence on the transmission efficiency of the audio. When it is too small, it affects energy consumption in propagation of the sound wave, and when it is too large, it increases the intensity of the magnetic field, so preferably, the interval between the permanent magnets 3 selects a size, so that a sum of areas of the bottoms 4 of the plurality of permanent magnets 3 is larger than or equal to one third of an area of the region of the coils of the vibrating diaphragm, and is smaller than or equal to two thirds of the area of the region of the coils of the vibrating diaphragm, thereby ensuring low energy consumption in transmission of the sound wave, while having a high intensity of the magnetic field.

Figure 6:
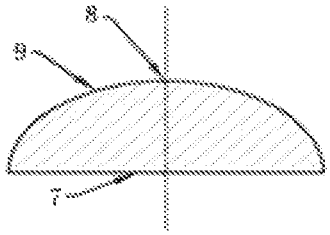
FIG. 6 is a diagram illustrating another example cross-sectional shape of a permanent magnet along A-A direction of FIG. 2 in accordance with the present disclosure.
Figure 7:
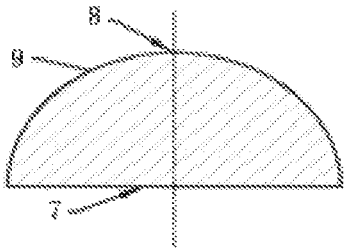
FIG. 7 is a diagram illustrating another example cross-sectional shape of a permanent magnet along A-A direction of FIG. 2 in accordance with the present disclosure.
Figure 8:
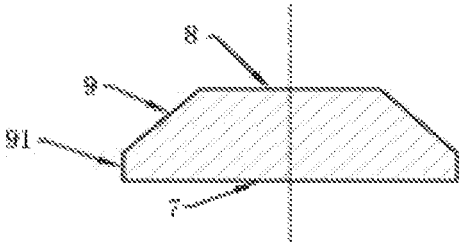
FIG. 8 is a diagram illustrating another example cross-sectional shape of a permanent magnet along A-A direction of FIG. 2 in accordance with the present disclosure.
Figure 9:
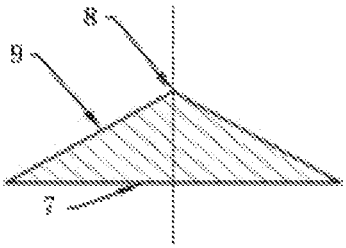
FIG. 9 is a diagram illustrating another example cross-sectional shape of a permanent magnet along A-A direction of FIG. 2 in accordance with the present disclosure.
Figure 10:
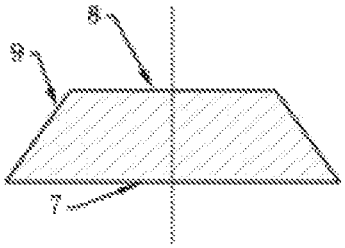
FIG. 10 is a diagram illustrating another example cross-sectional shape a permanent magnet along A-A direction of FIG. 2 in accordance with the present disclosure.
Figure 11:
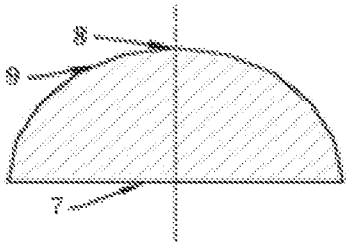
FIG. 11 is a diagram illustrating another example cross-sectional shape of a permanent magnet along A-A direction of FIG. 2 in accordance with the present disclosure.
Figure 12:
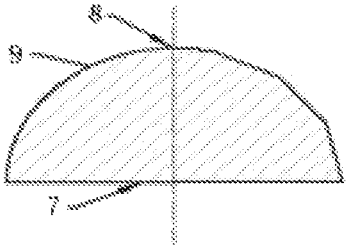
FIG. 12 is a diagram illustrating another example cross-sectional shape of a permanent magnet along A-A direction of FIG. 2 in accordance with the present disclosure.

An area of the top 5 of the permanent magnet 3 is smaller than an area of the bottom 4. The top 5 is a dot or a plane, and the waist 6 connecting the bottom 4 and the top 5 has a specific shape structure. The waist 6 includes a contraction part that contracts at least from the bottom 4 to the top 5, so as to promote uniform propagation of the sound wave to a rear of the permanent magnet 3, reduce attenuation and interference caused by coherence, and improve sound quality. The contracting method may be progressively contracting (as shown in FIGS. 4-7), also may be step contracting (as shown in FIGS. 8-10), and also may be a hybrid contracting (as shown in FIG. 11). Referring to FIGS. 4-11, FIGS. 4-11 illustrate cross-sectional shapes of the permanent magnets 3 in various contracting methods along A-A direction of FIG. 2. In these examples, a contour line of the cross-sectional shape of the permanent magnet 3 along the sound propagation direction consists of three parts: a bottom line 7, a top line 8, and a waist line 9 connecting the bottom 4 and the top 5.

In the progressively contracting method, the bilateral waist line 9 of the contraction part of the waist 6 is an arcuate curve. The arcuate curve is a hyperbolic curve, an arc, an elliptic arc, a parabola, an involute, an asteroid, an epicycloid, a hypocycloid, a catenary, a Cayley's Sextic, a cochleoid, a tractrix, a conchoids, a double folium, a spiral line, or a combination thereof. Preferably, the sectional shape of the progressively contracting permanent magnet 3 is a semi-ellipse (as shown in FIG. 6), or a semicircle (as shown in FIG. 7), so as to reduce processing difficulty and increase a range of sound transmission frequency.

In the step contracting method, the bilateral waist line 9 of the contraction part of the waist 6 is a straight line, or a broken line consisting of a plurality of line segments, wherein an angle between adjacent line segments is an obtuse angle. Although an angle between the bottom line 7 and the waist line 9 is reduced, this angle increases as the number of the line segments of the unilateral waist line 9 increases, so as to play a better role of reducing sound interference. Preferably, the sectional shape of the step contracting permanent magnet 3 is an isosceles triangle (as shown in FIG. 9), or an isosceles trapezoid (as shown in FIG. 10), so as to reduce processing difficulty.

The contraction part of the waist 6 also can contract in a hybrid manner, as shown in FIG. 11. The waist line 9 on one side of the contraction part of the waist 6 is a straight line, or a broken line consisting of a plurality of line segments, and the waist line 9 on the other side is an arcuate curve.

The contracting structure of the waist 6 of the permanent magnet 3 formed from the above three methods can ensure small angle deflection of the sound wave when the sound wave is propagated to a surface of the waist 6 of the permanent magnet 3, thereby reducing energy consumption of the sound wave, and reducing possibility of mutual interference of the sound wave. However, as to preparation of the permanent magnet 3, contracting from the bottom 4 of the permanent magnet 3 to the top 5 is more suitable on one hand for single molding with moulds, so that the moulds of abnormity section in such processing way are high in manufacturing costs, so as to increase production costs of the speaker, and on the other hand, has a small thickness of the permanent magnet 3, so that an angle between the bottom 4 and the waist 6 further decreases to form a sharp wedge structure at crossing of the bottom 4 and the waist 6, and sound easily causes mutual interference at this location, thereby affecting propagation effect of the sound.

Figure 4:
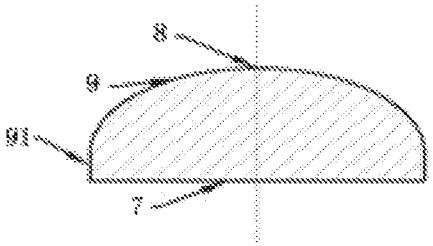
FIG. 4 is a diagram illustrating example cross-sectional shape of a permanent magnet along A-A direction of FIG. 2 in accordance with the present disclosure.
Figure 5:
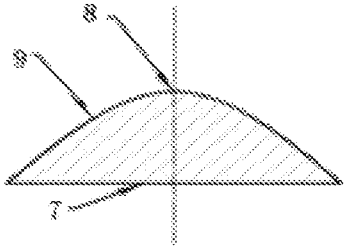
FIG. 5 is a diagram illustrating another example cross-sectional shape of a permanent magnet along A-A direction of FIG. 2 in accordance with the present disclosure.

Preferably, regardless of structures of the progressively contracting, step contracting or hybrid contracting permanent magnet 3, the waist 6 of the permanent magnet 3 may start to contract at a point with a certain distance from the bottom 4. That is, a length of the magnet along a direction parallel to the diaphragm starts to decrease at a point with a certain distance from the bottom 4. In such example, the waist line 9 is perpendicular to the bottom line 7, corresponding to a location of the line segment 91 of the waist line 9, as shown in FIGS. 4 and 8. On one hand, the angle between the bottom 4 and the waist 6 of the permanent magnet 3 can be increased, thereby improving sound effect. On the other hand, numerical control machine (CNC) process can be used, thereby reducing manufacturing costs of the permanent magnet 3.

Since this structure manner is used, a thickness of an edge of the permanent magnet 3 is reduced, so that the intensity of the magnetic field at the edge is also reduced, and energy conversion efficiency and sound quality are affected in a certain extent. In a preferable manner, the waist 6 of the permanent magnet 3 contracts from a lower point to the top 5. The lower point is at least ⅕H (H is the maximum size of a height of the permanent magnet along a direction perpendicular to the coils of the vibrating diaphragm) away from the top 5. More preferably, the lower point is ½H away from the top 5. The minimum size range of the line segment 91 can reduce a deviation of the intensity of the magnetic field between the edge and the center of the permanent magnet 3, and can obtain a better comprehensive effect in aspects of intensity of the magnetic field, sound effect and processing costs.

Example 2

Figure 13:
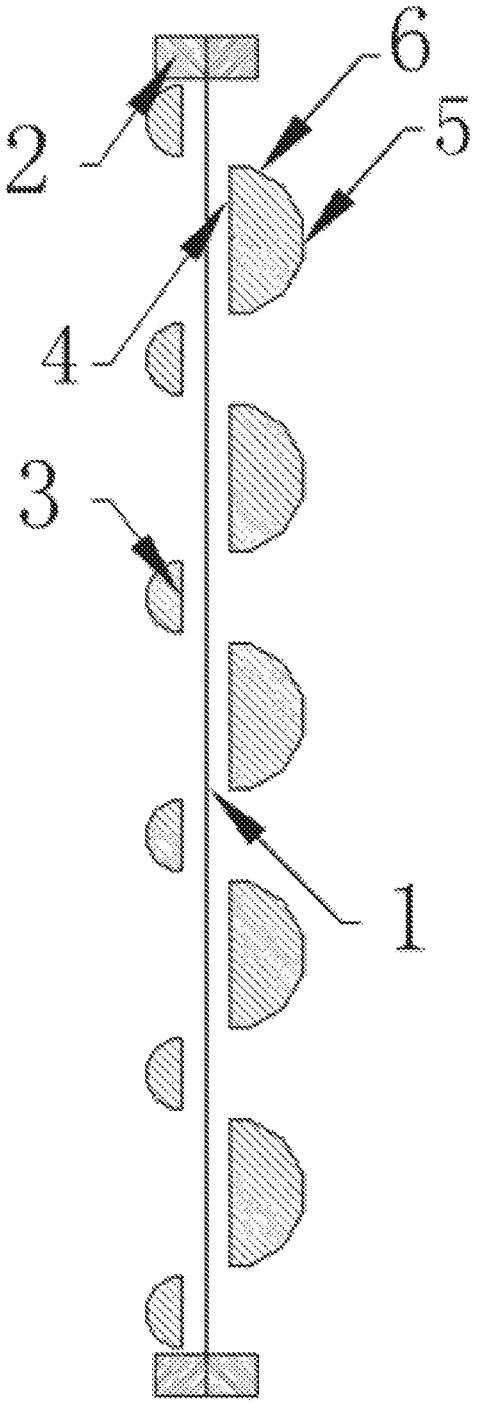
FIG. 13 is a schematic diagram illustrating another example isomagnetic speaker in accordance with the present disclosure.

Referring to FIG. 13, FIG. 13 illustrates another example isomagnetic speaker. The isomagnetic speaker comprises a vibrating diaphragm 1 with a periphery fixed by a framework 2, and coils on the vibrating diaphragm 1 are electrically connected to a signal line. Magnet yokes are respectively configured on both sides of the vibrating diaphragm 1, and comprise an array consisting of a plurality of permanent magnets 3 parallel to the vibrating diaphragm 1. The permanent magnet array is disposed corresponding to a region of the coils on the vibrating diaphragm 1, so as to ensure intensity of the magnetic field on the vibrating diaphragm 1, and enhance energy conversion efficiency. In the permanent magnet array of the interference-free magnetic structure for the isomagnetic speaker of the example, the permanent magnets 3 are arranged at an equal interval along any direction. The permanent magnets 3 in magnet yokes on both sides of the vibrating diaphragm 1 have the different size, and interval of the permanent magnets 3 can be different, i.e., using a non-symmetrical structure. Magnet yokes and coils on the vibrating diaphragm are omitted in the figure.

The permanent magnet 3 has rotational symmetry along the direction perpendicular to the coils of the vibrating diaphragm, and comprises a bottom 4, a top 5, and a waist 6 connecting the top 5 and the bottom 4. The bottom 4 is a plane, and the bottoms 4 of the plurality of permanent magnets 3 in the array share the same plane and are oriented to the coils of the vibrating diaphragm 1. In addition, the bottom 4 is also used as a magnetic pole of the permanent magnet 3, so that the magnetic field direction of the permanent magnet 3 is perpendicular to the bottom 4, and then perpendicular to the coils on the vibrating diaphragm 1. An arcuate chamfering is provided between the waist 6 and the bottom 4. The permanent magnet 3 uses a NdFeB magnet.

The maximum size of the permanent magnet 3 along a plane direction parallel to the coils of the vibrating diaphragm is smaller than or equal to $c/2\pi f_{min}$, wherein c is a sound wave speed (generally, 340 m/s), $f_{min}$ is the minimum output audio of the isomagnetic speaker. In order to be suitable for human hearing range, the maximum size of the permanent magnet 3 perpendicular to a sound propagation direction (parallel to a plane direction of the vibrating diaphragm 1) is selected to be in a range of 2.7 mm to 2.7 m. In order to be suitable for a wider usage, the size of the permanent magnet 3 is selected to be in a range of 2.4 mm to 10 m. A thickness of the permanent magnet 3 shall not be less than 0.5 cm. Preferably, the thickness of the permanent magnet 3 is preferably 1 cm to 5 m. A sum of areas of the bottoms 4 of the permanent magnets 3 in the permanent magnet array is larger than or equal to one third of an area of the region of the coils of the vibrating diaphragm, and is smaller than or equal to two thirds of the area of the region of the coils of the vibrating diaphragm.

An area of the top 5 of the permanent magnet 3 is smaller than an area of the bottom 4. The waist 6 includes a contraction part that contracts from the bottom 4 to the top 5. The contracting method may be progressively contracting, may be step contracting, and also may be a hybrid contracting. In this example, a contour line of the sectional shape of the permanent magnet 3 along the sound propagation direction consists of three parts: a bottom line 7, a top line 8, and a waist line 9 connecting the bottom 4 and the top 5.

In the progressively contracting method, the bilateral waist line 9 of the contraction part of the waist 6 is an arcuate curve. The arcuate curve is a hyperbolic curve, an arc, an elliptic arc, a parabola, an involute, an asteroid, an epicycloid, a hypocycloid, a catenary, a Cayley's Sextic, a cochleoid, a tractrix, a conchoids, a double folium, a spiral line, or a combination thereof. Preferably, the sectional shape of the progressively contracting permanent magnet 3 is a semi-ellipse, or a semicircle.

In the step contracting method, the bilateral waist line 9 of the contraction part of the waist 6 is a straight line, or a broken line consisting of a plurality of line segments, wherein an angle between adjacent line segments is an obtuse angle. Although an angle between the bottom line 7 and the waist line 9 is reduced, this angle increases as the number of the line segments of the unilateral waist line 9 increases, so as to play a better role of reducing sound interference. Preferably, the sectional shape of the step contracting permanent magnet 3 is an isosceles triangle, or an isosceles trapezoid.

The contraction part of the waist 6 also can contract in a hybrid manner. The waist line 9 on one side of the contraction part of the waist 6 is a straight line, or a broken line consisting of a plurality of line segments, and the waist line 9 on the other side is an arcuate curve.

Preferably, regardless of structures of the progressively contracting, step contracting or hybrid contracting permanent magnet 3, the waist 6 of the permanent magnet 3 may start to contract at a point with a certain distance from the bottom 4. That is, a length of the magnet along a direction parallel to the diaphragm starts to decrease at a point with a certain distance from the bottom 4. In such example, the waist line 9 is perpendicular to the bottom line 7, corresponding to a location of the line segment 91 of the waist line 9, as shown in FIGS. 4 and 8. In a preferable manner, the waist 6 of the permanent magnet 3 contracts from a lower point to the top 5. The lower point is at least ⅕H (H is the maximum size of a height of the permanent magnet along a direction perpendicular to the coils of the vibrating diaphragm) away from the top 5. More preferably, the lower point is ½H away from the top 5.

Example 3

Figure 14A:
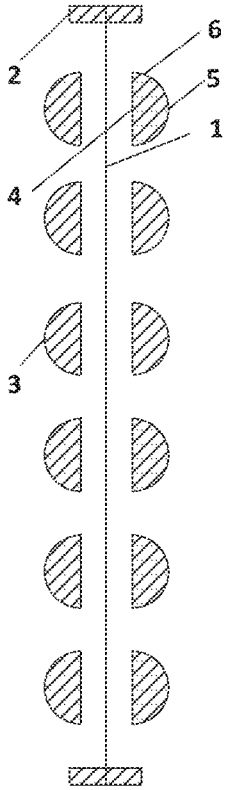
FIGS. 14A and 14B are schematic diagrams illustrating another example isomagnetic speaker in accordance with the present disclosure.
Figure 14B:
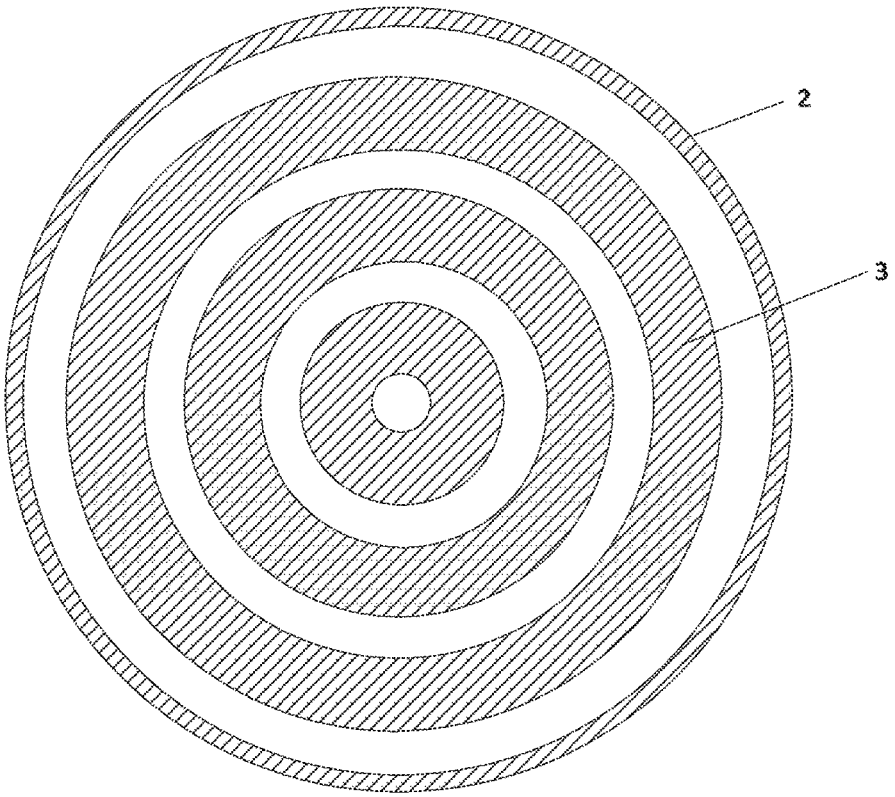
Figure 15:
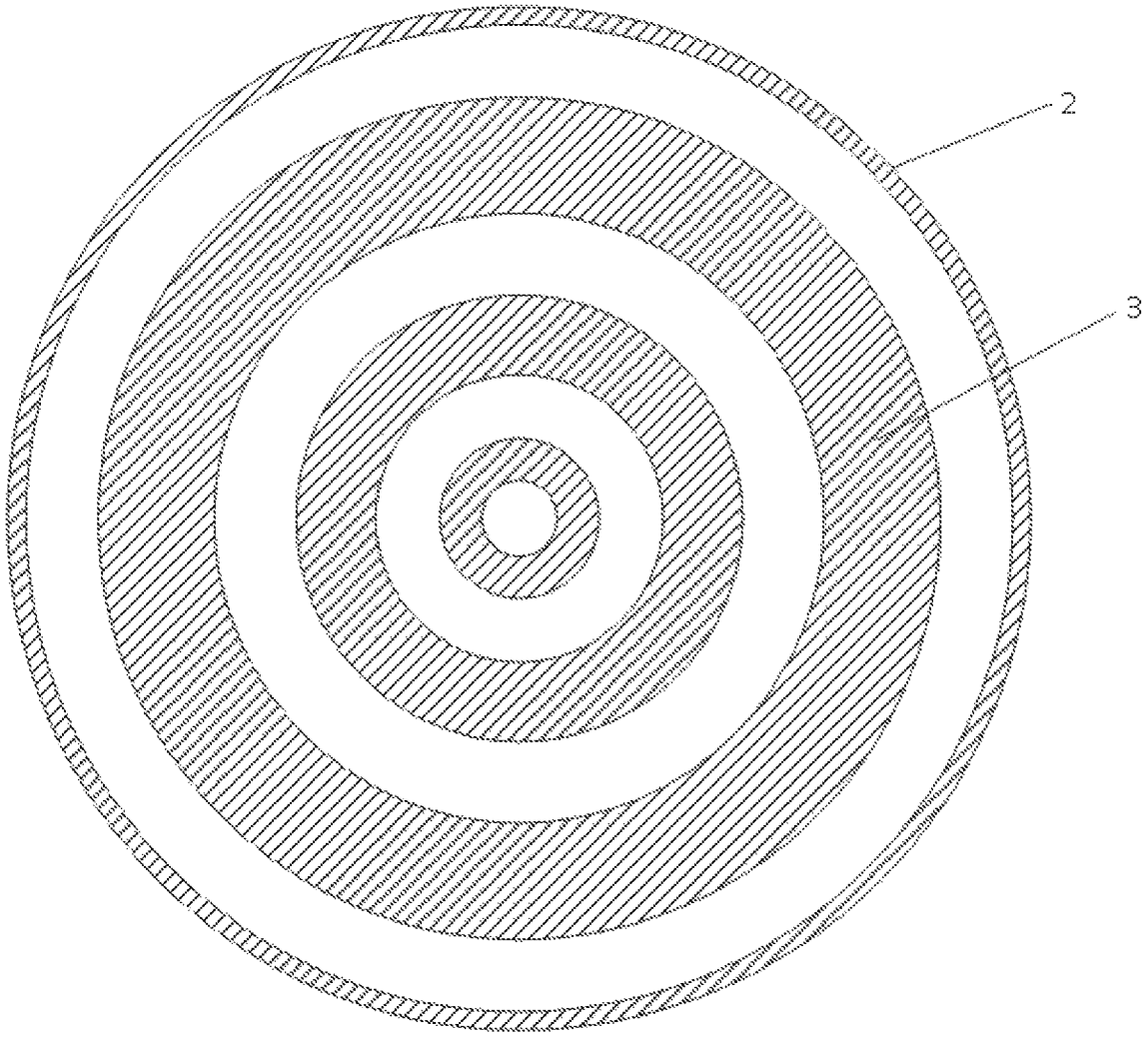
FIG. 15 is a schematic diagram illustrating another example magnet array of an interference-free magnetic structure for an isomagnetic speaker in accordance with the present disclosure.

Referring to FIGS. 14A and 14B, FIGS. 14A and 14B illustrate an isomagnetic speaker. The isomagnetic speaker comprises a vibrating diaphragm 1 with a periphery fixed by a framework 2, and coils on the vibrating diaphragm 1 are electrically connected to a signal line. Magnet yokes are respectively configured on both sides of the vibrating diaphragm 1, and comprise an array consisting of a plurality of permanent magnets 3 parallel to the vibrating diaphragm 1. The permanent magnet array is disposed corresponding to a region of the coils on the vibrating diaphragm 1, so as to ensure intensity of the magnetic field on the vibrating diaphragm 1 and enhance energy conversion efficiency. Referring to FIG. 15, FIG. 15 illustrates the permanent magnet array of an interference-free magnetic structure for an isomagnetic speaker in this example, wherein the permanent magnet 3 is an annular structure, and the plurality of permanent magnets 3 are sheathed at an equal interval along a radial direction. Radial sizes of bottoms of the permanent magnets 3 are the same or are decreased inwardly along the radial direction. The permanent magnets 3 in magnet yokes on both sides of the vibrating diaphragm 1 have the same size, and interval of the permanent magnets 3 can be the same, i.e., using a symmetrical structure. Magnet yokes and coils on the vibrating diaphragm are omitted in the figures.

An area of the top 5 of the permanent magnet is smaller than an area of the bottom 4. The radial maximum size of the bottom of the permanent magnet 3 is smaller than or equal to $c/2\pi f_{min}$, wherein c is a sound wave speed (generally, 340 m/s), $f_{min}$, is the minimum output audio of the isomagnetic speaker. The maximum size of the permanent magnets 3 perpendicular to a sound propagation direction (parallel to a plane direction of the vibrating diaphragm 1) is selected to be in a range of 2.7 mm to 2.7 m. In order to be suitable for a wider usage, the size of the permanent magnets is selected to be in a range of 2.4 mm to 10 m. A thickness of the permanent magnet 3 shall not be less than 0.5 cm. Preferably, the thickness of the permanent magnet 3 is 1 cm to 5 m. A sum of areas of the bottoms 4 of the permanent magnets 3 in the permanent magnet array is larger than or equal to one third of an area of the region of the coils of the vibrating diaphragm and is smaller than or equal to two thirds of the area of the region of the coils of the vibrating diaphragm.

The waist 6 includes a contraction part that contracts from the bottom 4 to the top 5. The contracting method may be progressively contracting, may be step contracting, and also may be a hybrid contracting. In this example, a contour line of the sectional shape of the permanent magnet 3 along the sound propagation direction consists of three parts: a bottom line 7, a top line 8, and a waist line 9 connecting the bottom 4 and the top 5.

In the progressively contracting method, the bilateral waist line 9 of the contraction part of the waist 6 is an arcuate curve. The arcuate curve is a hyperbolic curve, an arc, an elliptic arc, a parabola, an involute, an asteroid, an epicycloid, a hypocycloid, a catenary, a Cayley's Sextic, a cochleoid, a tractrix, a conchoids, a double folium, a spiral line, or a combination thereof. Preferably, the sectional shape of the progressively contracting permanent magnet 3 is a semi-ellipse, or a semicircle.

In the step contracting method, the bilateral waist line 9 of the contraction part of the waist 6 is a straight line, or a broken line consisting of a plurality of line segments, wherein an angle between adjacent line segments is an obtuse angle. Although an angle between the bottom line 7 and the waist line 9 is reduced, this angle increases as the number of the line segments of the unilateral waist line 9 increases, so as to play a better role of reducing sound interference. Preferably, the sectional shape of the step contracting permanent magnet 3 is an isosceles triangle, or an isosceles trapezoid.

The contraction part of the waist 6 also can contract in a hybrid manner. The waist line 9 on one side of the contraction part of the waist 6 is a straight line, or a broken line consisting of a plurality of line segments, and the waist line 9 on the other side is an arcuate curve.

Preferably, regardless of structures of the progressively contracting, step contracting or hybrid contracting permanent magnet 3, they can use that the waist 6 of the permanent magnet 3 contracts from a certain distance from the bottom 4 to the top 5, and the waist line 9 and the bottom line 10 form a structure of 90°, corresponding to a location of the line segment 91 of the waist line 9, as shown in FIGS. 4 and 8. In a preferable manner, the waist 6 of the permanent magnet 3 contracts from ⅕H (H is the maximum size of the permanent magnet along a direction perpendicular to the coils of the vibrating diaphragm) from the top 5 to the top 5. More preferably, the waist 6 contracts from ½H from the top 5 to the top 5.

Embodiments of the present disclosure are explicitly explained through the above example. However, those ordinary in the art shall understand that the above example is merely one of preferable examples of the present application. Due to limitation of length of the article, it is impossible to list all embodiments, and any implementation that can embody the technical solution of the claims of the disclosure is within the extent of protection of the present application.

It shall be noted that the above disclosures are further explicit explanations to the present disclosure in connect with detailed embodiments, and it shall not be understood that the detailed embodiments of the present disclosure are limited thereto. Under guidance of the above examples, those skilled in the art can make various improvements and variations on the basis of the above examples, and these improvements or variations fall into the extent of protection of the present application.

What is claimed is:

1. An interference-free magnet structure for an isomagnetic speaker comprising a diaphragm, comprising:

a magnet array disposed to correspond with a predetermined region of the diaphragm and comprising a plurality of permanent magnets, the plurality of permanent magnets disposed at equal intervals along at least one direction;

wherein each of the plurality of permanent magnets comprises a bottom, a top and a waist portion connecting the top and the bottom, and the bottom is disposed closer to the diaphragm than the top;

wherein a magnetic field direction of each permanent magnet is perpendicular to a corresponding bottom, and a plurality of bottoms of the plurality of permanent magnets are arranged on a same plane and are oriented toward the diaphragm; and wherein a maximum size of a length of each permanent magnet along a direction parallel to the diaphragm is smaller than or equal to $c/2\pi f_{min}$, wherein c is a sound wave speed, and $f_{min}$ is a minimum output audio frequency of the isomagnetic speaker.

2. The interference-free magnet structure according to claim 1, wherein the maximum size of the length is greater than or equal to 2.4 mm and less than or equal to 10 m.

3. The interference-free magnet structure according to claim 1, wherein a sum of areas of the plurality of bottoms is larger than or equal to one third of an area of the predetermined region of the diaphragm, and smaller than or equal to two thirds of the area of the predetermined region of the diaphragm.

4. The interference-free magnet structure according to claim 1, wherein an area of the top of each permanent magnet is smaller than an area of the bottom.

5. The interference-free magnet structure according to claim 1, wherein a maximum size of a height of each permanent magnet along a direction perpendicular to the diaphragm is greater than or equal to 5 mm and less than or equal to 20 m.

6. The interference-free magnet structure according to claim 5, wherein the waist portion includes a contraction part in which the length decreases from a lower point to the top, and the lower point is at least one fifth of the maximum size of the height away from the top.

7. The interference-free magnet structure according to claim 6, wherein an outer contour line of at least one side of the contraction part is an arcuate curve.

8. The interference-free magnet structure according to claim 7, wherein the arcuate curve is a hyperbolic curve, an arc, an elliptic arc, a parabola, an involute, an asteroid, an epicycloid, a hypocycloid, a catenary, a Cayley's sextic, a cochleoid, a tractrix, a conchoids, a double folium, a spiral line, or a combination thereof.

9. The interference-free magnet structure according to claim 6, wherein an outer contour line of at least one side of the contraction part is a straight line, or a line comprising a plurality of line segments.

10. The interference-free magnet structure according to claim 1, wherein a cross-sectional shape of each permanent magnet along a direction perpendicular to the diaphragm is an isosceles triangle, an isosceles trapezoid, a semicircle, or a semi-ellipse.

11. The interference-free magnet structure according to claim 1, wherein each permanent magnet has a rotational symmetry around a direction perpendicular to the diaphragm.

12. The interference-free magnet structure according to claim 1, wherein the bottom is a plane and has a shape of a regular polygon, a circle, an ellipse, or a rectangle.

13. The interference-free magnet structure according to claim 1, wherein each of the plurality of bottoms is ring-shaped, and the plurality of permanent magnets are disposed at equal intervals along a radial direction of the same plane.

14. The interference-free magnet structure according to claim 13, wherein each of the plurality of bottoms has a same width in the radial direction.

15. The interference-free magnet structure according to claim 12, wherein a width of an outer permanent magnet in the radial direction is greater than a width of an inner permanent magnet in the radial direction.

16. The interference-free magnet structure according to claim 1, wherein an arcuate chamfer is provided between the waist portion and the bottom.

17. An isomagnetic speaker, comprising:

a diaphragm coupled to a frame;

a magnet array disposed to correspond with a predetermined region of the diaphragm and comprising a plurality of permanent magnets, the plurality of permanent magnets disposed at equal intervals along at least one direction;

wherein each of the plurality of permanent magnets comprising a bottom, a top, and a waist portion connecting the top and the bottom, and the bottom disposed closer to the diaphragm than the top;

wherein a plurality of bottoms of the plurality of permanent magnets are arranged on a same plane and oriented toward the diaphragm, and a magnetic field direction of each permanent magnet is perpendicular to a corresponding bottom; and wherein a maximum size of a length of each permanent magnet along a direction parallel to the diaphragm is smaller than or equal to $c/2\pi f_{min}$, wherein c is a sound wave speed, and $f_{min}$ is a minimum output audio frequency of the isomagnetic speaker.

18. The isomagnetic speaker according to claim 17, wherein a sum of areas of the plurality of bottoms is larger than or equal to one third of an area of the predetermined region of the diaphragm, and smaller than or equal to two thirds of the area of the predetermined region of the diaphragm.

19. The isomagnetic speaker according to claim 17, wherein the waist portion comprises a contraction part in which the length decreases from a lower point to the top, and wherein an outer contour line of at least one side of the contraction part is an arcuate curve, a straight line, or a line comprising a plurality of line segments.

20. The isomagnetic speaker according to claim 17, wherein each of the plurality of bottoms is ring-shaped, and the plurality of permanent magnets are disposed at equal intervals in a radial direction of the same plane.

* * * * *